US009311796B2

(12) United States Patent
Bergman et al.

(10) Patent No.: US 9,311,796 B2
(45) Date of Patent: Apr. 12, 2016

(54) SYSTEMS AND METHODS FOR ADAPTIVELY CONTROLLING A TRANSMITTER FIELD

(71) Applicants: Adam S. Bergman, Boca Raton, FL (US); Manuel Soto, Lake Worth, FL (US)

(72) Inventors: Adam S. Bergman, Boca Raton, FL (US); Manuel Soto, Lake Worth, FL (US)

(73) Assignee: Tyco Fire & Security GmbH, Rheinfall (CH)

( * ) Notice: Subject to any disclaimer, the term of this patent is extended or adjusted under 35 U.S.C. 154(b) by 84 days.

(21) Appl. No.: 14/466,046

(22) Filed: Aug. 22, 2014

(65) Prior Publication Data

US 2016/0055730 A1 Feb. 25, 2016

(51) Int. Cl.
*G08B 13/24* (2006.01)

(52) U.S. Cl.
CPC ..... *G08B 13/2402* (2013.01)

(58) Field of Classification Search
CPC ..... G08B 13/14; G08B 13/1645
USPC ..... 340/541, 5.64, 10.1, 10.51, 506, 340/572.1–572.8; 342/429, 445
See application file for complete search history.

(56) References Cited

U.S. PATENT DOCUMENTS

| | | | | |
|---|---|---|---|---|
| 4,510,489 | A | 4/1985 | Anderson, III et al. | |
| 4,510,490 | A | 4/1985 | Anderson, III et al. | |
| 6,307,473 | B1 * | 10/2001 | Zampini | G08B 13/1645 340/10.1 |
| 8,451,125 | B2 * | 5/2013 | Hong | A47F 9/04 340/10.1 |
| 8,587,432 | B2 * | 11/2013 | Mulla | G06Q 10/08 340/10.1 |
| 2012/0044074 | A1 | 2/2012 | Mulla | |

FOREIGN PATENT DOCUMENTS

| | | | |
|---|---|---|---|
| EP | 0435198 | A2 | 7/1991 |
| WO | 01/15103 | A1 | 3/2001 |

* cited by examiner

*Primary Examiner* — Tai T Nguyen
(74) *Attorney, Agent, or Firm* — Fox Rothschild LLP; Robert J. Sacco; Carol E. Thorstad-Forsyth

(57) ABSTRACT

Systems (100) and methods (600-800) for adaptively controlling a transmitter field in an Electronic Article Surveillance ("EAS") detection system. The methods comprise: detecting, by at least one first proximity sensor (108*a*, 108*b*), a presence of a first person located in proximity to a pedestal (102*a*, 102*b*) of the EAS detection system; determining a first distance from the first proximity sensor to the first person; and using the first distance to adaptively control the transmitter field of the EAS detection system.

20 Claims, 7 Drawing Sheets

SYSTEMS AND METHODS FOR ADAPTIVELY CONTROLLING A TRANSMITTER FIELD

BACKGROUND OF THE INVENTION

1. Statement of the Technical Field

The present invention relates generally to Electronic Article Surveillance ("EAS") detection systems. More particularly, the present invention relates to systems and implementing methods for adaptively controlling a transmitter of an EAS detection system.

2. Description of the Related Art

EAS detection systems generally comprise an interrogation antenna for transmitting an electromagnetic signal into an interrogation zone, markers which respond in some known electromagnetic manner to the interrogation signal, an antenna for detecting the response of the marker, a signal analyzer for evaluating the signals produced by the detection antenna, and an alarm which indicates the presence of a marker in the interrogation zone. The alarm can then be the basis for initiating one or more appropriate responses depending upon the nature of the facility. Typically, the interrogation zone is in the vicinity of an exit from a facility such as a retail store, and the markers can be attached to articles such as items of merchandise or inventory.

One type of EAS detection system utilizes AcoustoMagnetic ("AM") markers. The general operation of an AM EAS detection system is described in U.S. Pat. Nos. 4,510,489 and 4,510,490, the disclosure of which is herein incorporated by reference. The detection of markers in an AM EAS detection system by pedestals placed at an exit has always been specifically focused on detecting markers only within the spacing of the pedestals. However, the interrogation field generated by the pedestals may extend beyond the intended detection zone. For example, a first pedestal will generally include a main antenna field directed toward a detection zone located between the first pedestal and a second pedestal. When an exciter signal is applied at the first pedestal it will generate an electro-magnetic field of sufficient intensity so as to excite markers within the detection zone. Similarly, the second pedestal will generally include an antenna having a main antenna field directed toward the detection zone (and toward the first pedestal). An exciter signal applied at the second pedestal will also generate an electromagnetic field with sufficient intensity so as to excite markers within the detection zone. When a marker tag is excited in the detection zone, it will generate an electromagnetic signal which can usually be detected by receiving the signal at the antennas associated with the first and second pedestal.

SUMMARY OF THE INVENTION

The present invention concerns implementing systems and methods for adaptively controlling a transmitter field in an EAS detection system. The methods comprise: detecting, by at least one first proximity sensor, a presence of a first person located in proximity to a pedestal of the EAS detection system; determining a first distance from the first proximity sensor to the first person; and using the first distance to adaptively control the transmitter field of the EAS detection system. The transmitter field is controlled by adjusting a transmit power of the first pedestal. The transmit power of the first pedestal is returned to its previous level when the first person moves out of an antenna field pattern.

In some scenarios, distance information associated with a person located in the back-field of a radiation pattern of a pedestal's antenna should not be used for controlling transmit power. As such, the methods may also involve determining if the first person is located in a back-field of a radiation pattern of an antenna of the first pedestal. The first distance may only be used for said adaptive control if it is determined that the first person is not located in the back-field of the radiation pattern of the antenna of the first pedestal. Alternatively, the first distance may only be used for said adaptive control if it is determined that the first person is located in the back-field of the radiation pattern of the antenna of the first pedestal and if distance information associated with a person located in the back-field should be used to control transmit power of a pedestal.

In other scenarios, distance information from two or more sensors of the EAS detection system may be conflicting. As such, the methods may further involve: determining a second distance from a second proximity sensor to the first person; and determining if the first and second distances are the same. Either the first distance or second distance is selected for controlling transmit power if a determination is made that the first and second distances are the same. Alternatively, a smallest distance is selected from the first and second distances if a determination is made that the first and second distance are not the same. In this case, the smallest distance is used to control transmit power.

In other scenarios, two or more people may be located in proximity to the pedestal. As such, the methods may also involve: detecting a presence of a second person located in proximity to a pedestal of the EAS detection system while the first person is located in proximity to the pedestal; determining a second distance from the pedestal to the second person; and determining if the first and second distances are the same. Either the first distance or the second distance is selected for controlling transmit power if a determination is made that the first and second distances are the same. Alternatively, a smallest distance is selected from the first and second distances if a determination is made that the first and second distance are not the same. The smallest distance is used to control transmit power: (A) if it is determined that the person associated with the smallest distance is not located in the back-field of the radiation pattern of the antenna of the first pedestal, or (B) if it is determined that the person associated with the smallest distance is located in the back-field of the radiation pattern of the antenna of the first pedestal and if distance information associated with a person located in the back-field should be used to control transmit power of a pedestal.

BRIEF DESCRIPTION OF THE DRAWINGS

Embodiments will be described with reference to the following drawing figures, in which like numerals represent like items throughout the figures, and in which.

DETAILED DESCRIPTION OF THE INVENTION

Figure 1:
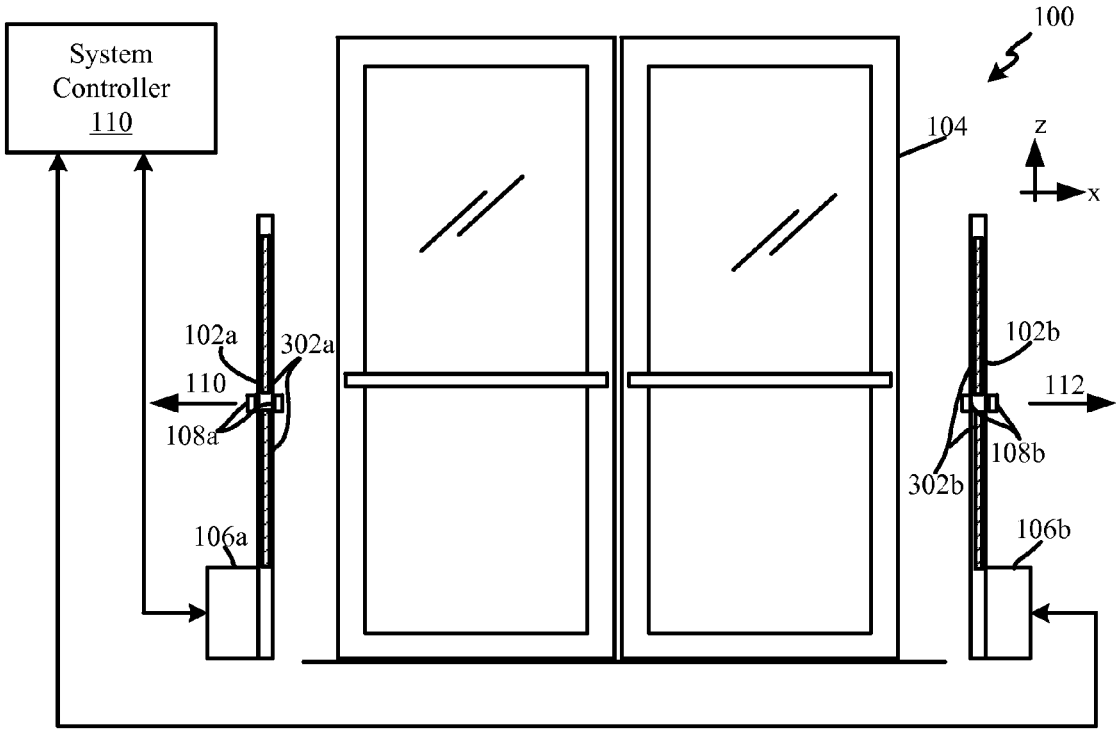
FIG. 1 is a side view of an EAS detection system.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

Furthermore, the described features, advantages and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment", "an embodiment", or similar language means that a particular feature, structure, or characteristic described in connection with the indicated embodiment is included in at least one embodiment of the present invention. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

The present invention generally provides systems and implementing methods for adjusting EAS detection system power based on proximity information. In this regard, sensors (e.g., ultrasonic transducers) are mounted on the pedestals of the EAS detection system. These sensors facilitate detection of persons located in proximity to the pedestals. Upon such detection, the transmitter power of the EAS detection system is attenuated such that the levels are optimized for system performance. In effect, the EAS detection system experiences power savings, a reduction in back-field detection, and an improved detection consistency as compared to that of conventional EAS detection systems.

Figure 2:
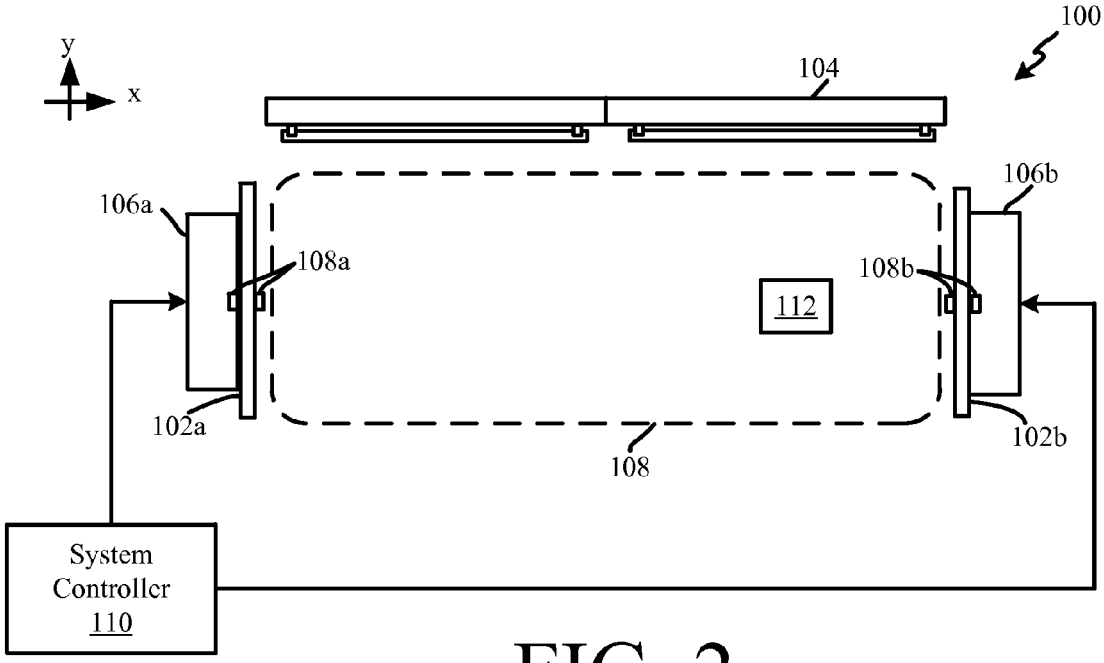
FIG. 2 is a top view of the EAS detection system in FIG. 1, which is useful for understanding an EAS detection zone thereof.

Referring now to FIGS. 1 and 2, an exemplary architecture for an EAS detection system 100 is provided. Notably, the present invention is described herein in terms of an AM EAS detection system. However, the method of the invention can also be used in other types of EAS detection systems, including systems that use Radio Frequency ("RF") type tags and Radio Frequency IDentification ("RFID") EAS detection systems.

The EAS detection system 100 will be positioned at a location adjacent to an entry/exit 104 of a secured facility (e.g., a retail store). The EAS detection system 100 uses specially designed EAS marker tags ("security tags") which are applied to store merchandise or other items which are stored within a secured facility. The security tags can be deactivated or removed by authorized personnel at the secure facility. For example, in a retail environment, the security tags could be removed by store employees. When an active security tag 112 is detected by the EAS detection system 100 in an idealized representation of an EAS detection zone 108 near the entry/exit, the EAS detection system will detect the presence of such security tag and will sound an alarm or generate some other suitable EAS response. Accordingly, the EAS detection system 100 is arranged for detecting and preventing the unauthorized removal of articles or products from controlled areas.

The EAS detection system 100 includes a pair of pedestals 102*a*, 102*b*, which are located a known distance apart (e.g., at opposing sides of entry/exit 104). The pedestals 102*a*, 102*b* are typically stabilized and supported by a base 106*a*, 106*b*. The pedestals 102*a*, 102*b* will each generally include one or more antennas that are suitable for aiding in the detection of the special EAS security tags, as described herein. For example, pedestal 102*a* can include at least one antenna 302 suitable for transmitting or producing an electromagnetic exciter signal field and receiving response signals generated by security tags in the detection zone 108. In some embodiments, the same antenna can be used for both receive and transmit functions. Similarly, pedestal 102*b* can include at least one antenna 402 suitable for transmitting or producing an electromagnetic exciter signal field and receiving response signals generated by security tags in the detection zone 108. The antennas provided in pedestals 102*a*, 102*b* can be conventional conductive wire coil or loop designs as are commonly used in AM type EAS pedestals. These antennas will sometimes be referred to herein as exciter coils. In some embodiments, a single antenna can be used in each pedestal. The single antenna is selectively coupled to the EAS receiver. The EAS transmitter is operated in a time multiplexed manner. However, it can be advantageous to include two antennas (or exciter coils) in each pedestal as shown in FIG. 1, with an upper antenna positioned above a lower antenna.

The antennas located in the pedestals 102*a*, 102*b* are electrically coupled to a system controller 110. The system controller 110 controls the operation of the EAS detection system 100 to perform EAS functions as described herein. The system controller 110 can be located within a base 106*a*, 106*b* of one of the pedestals 102*a*, 102*b* or can be located within a separate chassis at a location nearby to the pedestals. For example, the system controller 110 can be located in a ceiling just above or adjacent to the pedestals 102*a*, 102*b*.

As noted above, the EAS detection system comprises an AM type EAS detection system. As such, each antenna is used to generate an Electro-Magnetic ("EM") field which serves as a security tag exciter signal. The security tag exciter signal causes a mechanical oscillation of a strip (e.g., a strip formed of a magnetostrictive or ferromagnetic amorphous metal) contained in a security tag within a detection zone 108. As a result of the stimulus signal, the security tag will resonate and mechanically vibrate due to the effects of magnetostriction. This vibration will continue for a brief time after the stimulus signal is terminated. The vibration of the strip causes variations in its magnetic field, which can induce an AC signal in the receiver antenna. This induced signal is used to indicate a presence of the strip within the detection zone 108. As noted above, the same antenna contained in a pedestal 102*a*, 102*b* can serve as both the transmit antenna and the receive antenna. Accordingly, the antennas in each of the pedestals 102*a*, 102*b* can be used in several different modes to detect a security tag exciter signal. These modes will be described below in further detail.

Figure 3:
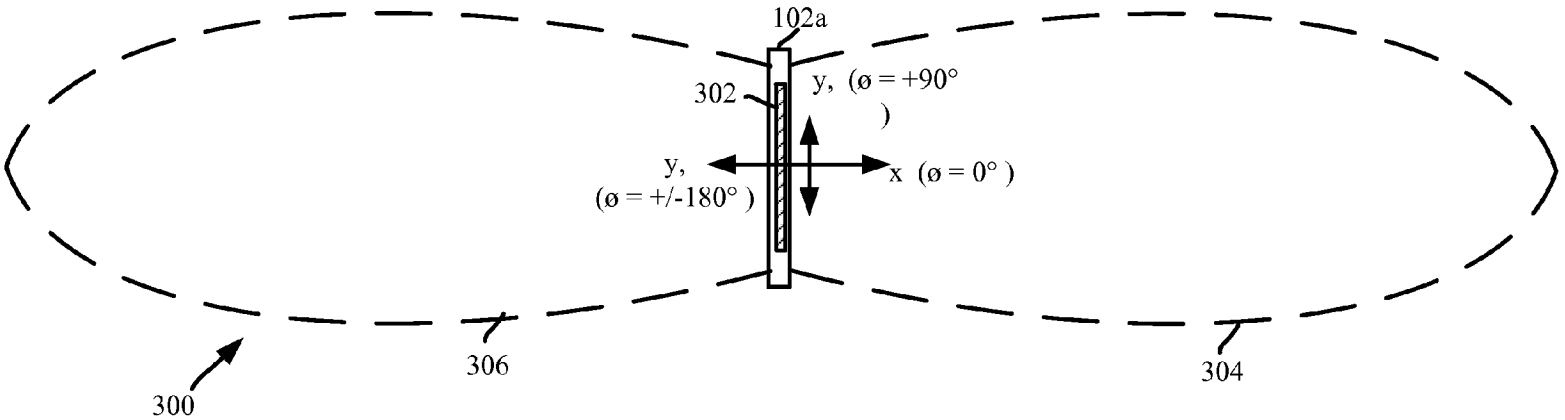
FIGS. 3 and 4 are drawings which are useful for understanding a main field and a back-field of antennas which are used in the EAS detection system of FIG. 1.
Figure 4:
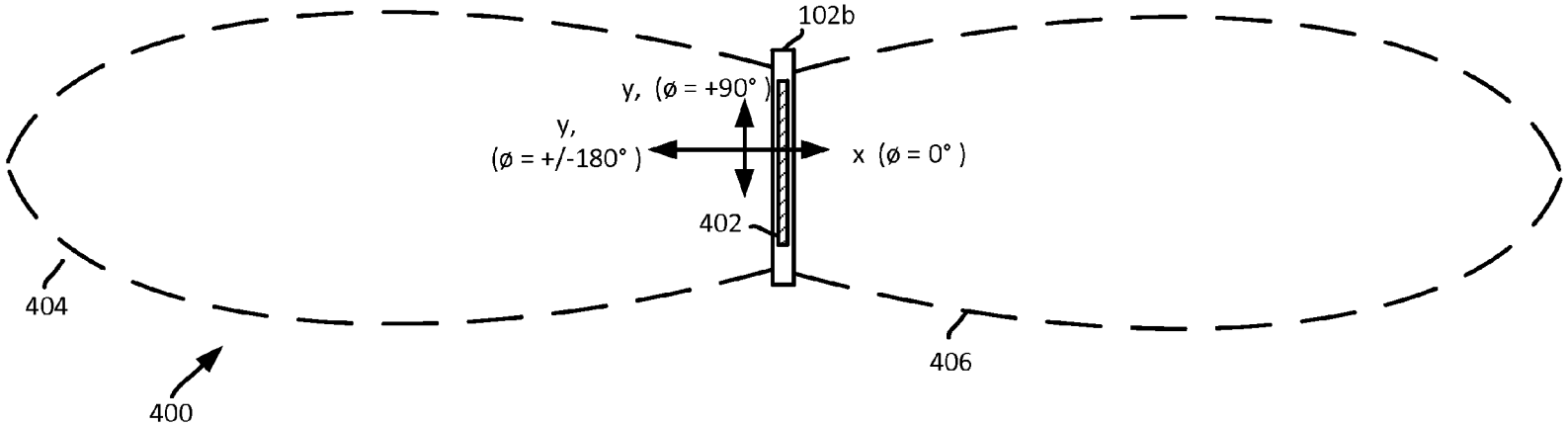

Referring now to FIGS. 3 and 4, there are shown exemplary antenna field patterns 300, 400 for antennas 302, 402 contained in pedestals 102*a*, 102*b*. As is known in the art, an antenna radiation pattern is a graphical representation of the radiating (or receiving) properties for a given antenna as a function of space. The properties of an antenna are the same in a transmit mode and a receive mode of operation. As such, the antenna radiation pattern shown is applicable for both transmit and receive operations as described herein. The exemplary antenna field patterns 300, 400 shown in FIGS. 3-4 are azimuth plane pattern representing the antenna pattern in the x, y coordinate plane. The azimuth pattern is represented in polar coordinate form and is sufficient for understanding the inventive arrangements. The azimuth antenna field patterns shown in FIGS. 3-4 are a useful way of visualizing the direction in which the antennas 302, 402 will transmit and receive signals at a particular transmitter power level.

Figure 5:
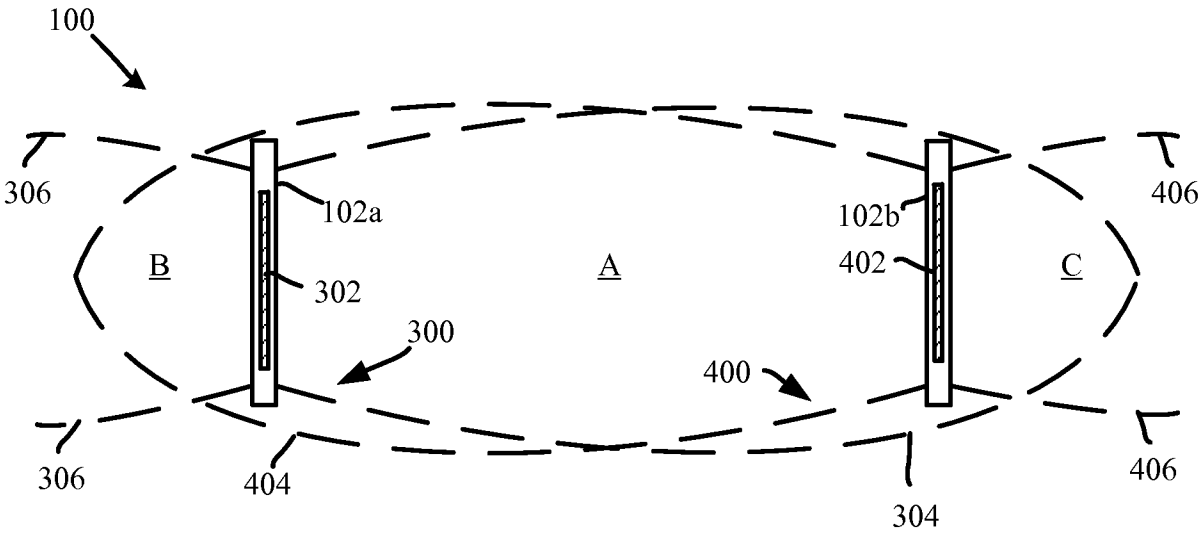
FIG. 5 is a drawing which is useful for understanding a detection zone in the EAS detection system of FIG. 1.

The antenna field pattern 300 shown in FIG. 3 includes a main lobe 304 with a peak at ø=0° and a back-field lobe 306 with a peak at angle ø=180°. Conversely, the antenna field pattern 400 shown in FIG. 4 includes a main lobe 404 with its peak at ø=180° and a back-field lobe 406 with a peak at angle ø=0°. In the EAS detection system 100, each pedestal 102*a*, 102*b* is positioned so that the main lobe of an antenna contained therein is directed into the detection zone 108. Accordingly, a pair of pedestals 102*a*, 102*b* in the EAS detection system 100 will produce overlap in the antenna field patterns 300, 400, as shown in FIG. 5. Notably, the antenna field patterns 300, 400 shown in FIG. 5 are scaled for purposes of understanding the present invention. In particular, the patterns show the outer boundary or limits of an area in which an exciter signal of particular amplitude applied to antennas 302, 402 will produce a detectable response in an EAS security tag. However, it should be understood that a security tag within the bounds of at least one antenna field pattern 300, 400 will generate a detectable response when stimulated by an exciter signal.

The overlapping antenna field patterns 300, 400 in FIG. 5 will include an area A where there is overlap of main lobes 304, 404. However, it can be observed in FIG. 5 that there can also be some overlap of a main lobe of each pedestal with a back-field lobe associated with the other pedestal. For example, it can be observed that the main lobe 404 overlaps with the back-field lobe 306 within an area B. Similarly, the main lobe 304 overlaps with the back-field lobe 306 in an area C. Area A between pedestals 102*a*, 102*b* defines the detection zone 108 in which active security tags should cause the EAS detection system 100 to generate an alarm response. Security tags in area A are stimulated by energy associated with an exciter signal within the main lobes 304, 404 and will produce a response which can be detected at each antenna. The response produced by a security tag in area A is detected within the main lobes of each antenna and processed in the system controller 110. Notably, a security tag in areas B or C will also be excited by the antennas 302, 402. The response signal produced by a security tag in these areas B and C will also be received at one or both antennas. This response signal is referred to herein as a "security tag signal".

Referring again to FIGS. 1-2, a plurality of proximity sensors (e.g., ultrasonic transducers) 108*a*, 108*b* is advantageously mounted on each pedestal 102*a* or 102*b*. Proximity sensors and ultrasonic transducers are well known in the art, and therefore will not be described herein. Still, it should be understood that each proximity sensor 108*a*, 108*b* is generally configured to detect the presence of a person and/or object located on a given side of a respective pedestal, as well as his/her/its distance from the same.

Accordingly, the proximity sensors 108*a*, 108*b* are arranged to point in both a front-field and a back-field of each respective pedestal 102*a*, 102*b*. As such, a first one of the proximity sensors points in a first direction shown by arrow 110, and thus detects persons located in the back-field of the respective pedestal. A second proximity sensor points in a second opposite direction shown by arrow 112, and therefore detects persons located in the front-field of the respective pedestal.

In the ultrasonic transducer scenario, each proximity sensor: generates high frequency sound waves; transmits the high frequency sound waves in a given direction; and receives echo signals from persons and/or objects located in range of the transmitted high frequency sound waves. Next, the system controller 110 determines a time interval between a first time at which a respective high frequency sound wave was transmitted from the proximity sensor and a second time at which the echo signal was received by the proximity sensor. The time interval is then used by the system controller 110 to determine the distance from a respective pedestal to the person/object based on the previously determined time interval. The determined distance is then used to control the EAS transmitter power separately and/or independently for each pedestal. The EAS transmitter power is returned to its original level after the person moves a certain distance from the pedestal (e.g., a sufficient distance so as to no longer reside in the interrogation zone).

By controlling the EAS transmitter power for a pedestal, the size of its antenna field pattern is dynamically adjusted based on proximity information regarding persons located in proximity to the pedestals. Since the EAS transmitter power for each pedestal is adjusted independently from that of the other pedestal, the antenna field patterns of the two pedestals can be the same or different at any given time. For example, let's assume that a person is located closer to pedestal 102*a* as compared to pedestal 102*b*. In this case, the antenna field pattern of pedestal 102*a* is adjusted to decrease it overall size by an amount greater than the amount by which the antenna field pattern for pedestal 102*b* is decreased.

In some scenarios, distance information associated with persons located in the back-field is ignored, i.e., not used to control the EAS transmitter power. As such, only distance information associated with persons located between pedestals 102*a*, 102*b* is used for adaptively controlling the antenna field patterns of the two pedestals 102*a*, 102*b*. In other scenarios, this is not the case, and distance information associated with persons located in the front and back-fields is used to control the strengths of transmitter fields.

In those and other scenarios, the sensors 108*a* and 108*b* may generate conflicting information about the distance a particular person is relative to a given pedestals 102*a* or 102*b*. For example, proximity sensor 108*a* generates information indicating that a person is three feet away from pedestal 102*a*. In contrast, proximity sensor 108*b* generates information indicating that a person is two feet away from pedestal 102*a*. As such, the information generated by the two proximity sensors is conflicting. Accordingly, the transmitter power for pedestal 102*a* is adjusted based on the information generated by proximity sensor 108*b* instead of the information generated by proximity sensor 108*a*, i.e., the sensor information indicating the smallest distance from pedestal 102*a*.

In most cases, only one person having possession of an active security tag will be located in proximity to the pedestals 102*a*, 102*b*. However, there are some scenarios in which two or more persons having possession of active security tags are located in proximity to the pedestals 102*a*, 102*b*. In this case, a determination is made as to which person is closer to a given pedestal. The distance information associated with this person (i.e., the closet person) is then used to adaptively control the transmitter field of a given pedestal.

In all cases, the antenna field patterns of pedestals 102*a* and 102*b* are selectively reduced so as to obtain the following advantages: (1) power savings; (2) a reduction in back-field detections; and/or (3) an improvement in detection consistency. With regard to advantage (1), power savings are achieved simply by reducing transmitter power in certain scenarios (e.g., when a person is located in proximity to a pedestal). With regard to advantage (2), the back-field detection reduction is achieved by ignoring security tag signals associated with persons located in the back-field. With regard to advantage (3), it should be understood that a security tag signal may not be detected when it is very close to the pedestal since the transmitter field is relatively strong at that location. The relatively strong transmitter field causes the amplitude of the security tag signal to exceed a given threshold value, and therefore is considered by system 100 to not constitute a detected security tag signal. By decreasing the antenna field pattern and/or transmitter field, the transmitter field strength close to the transmitter is reduced, whereby the amplitude of the security tag signal is also decreased. In effect, the amplitude of the security tag signal falls below the threshold value. As a result, the security tag signal is properly detected within system 100.

Figure 6:
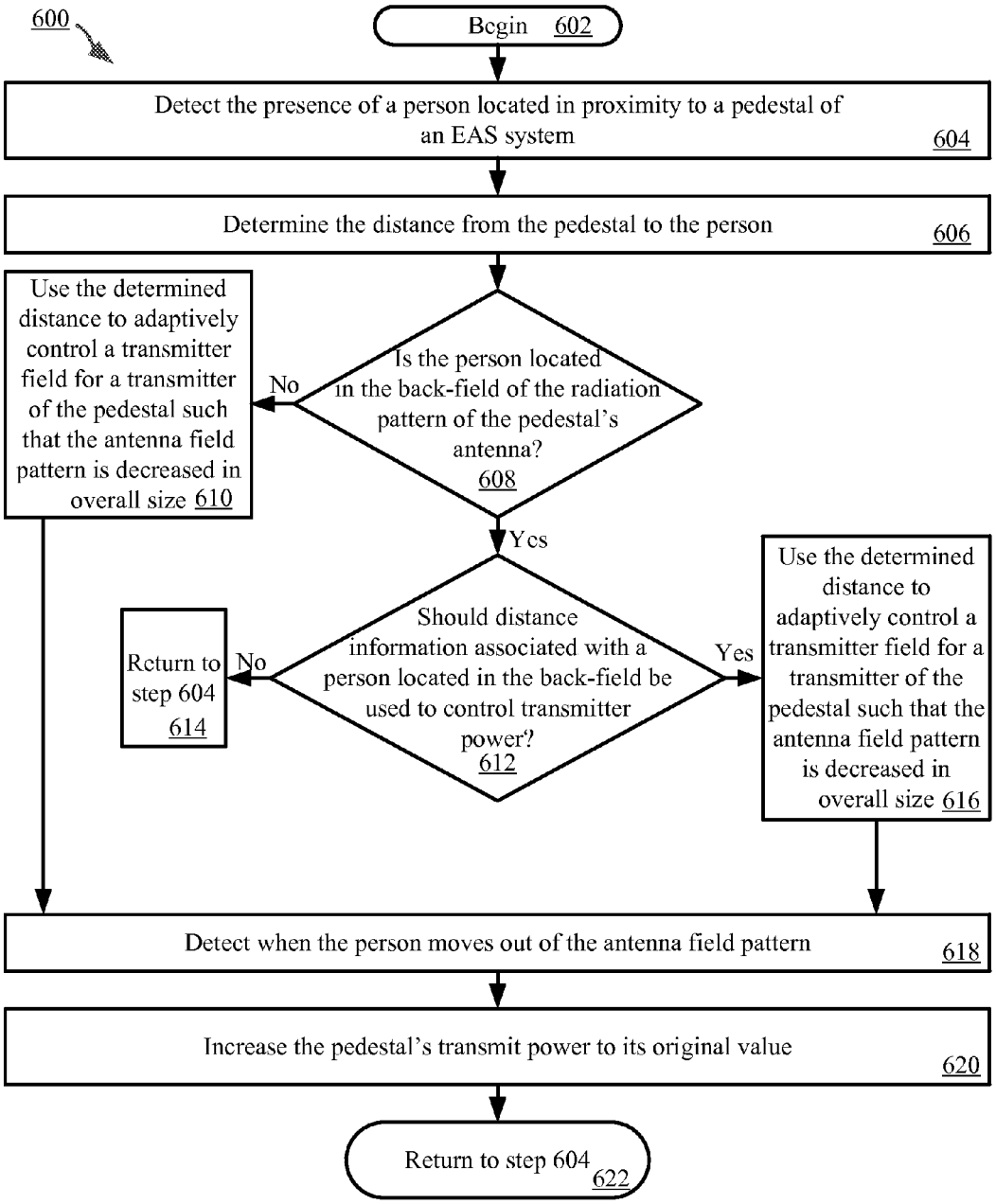
FIGS. 6-8 each provide a flowchart of an exemplary method for adaptively controlling a transmitter field in an EAS detection system.

Referring now to FIG. 6, there is provided a flowchart of an exemplary method 600 for adaptively controlling a transmitter field in an EAS detection system. Method 600 begins with step 602 and continues with step 604. In step 604, the presence of a person located in proximity to a pedestal (e.g., pedestal 102*a* or 102*b* of FIG. 1) of the EAS detection system is detected. Next, a distance is determined from the pedestal to the person, as shown by step 606.

Thereafter, a decision is made as to whether or not the person is located within the backfield of the radiation pattern of the pedestal's antenna. If the person is not located in the back-field [608:NO], then step 610 is performed. Step 610 involves using the determined distance to adaptively control a transmitter field for a transmitter of the pedestal such that the antenna field pattern is decreased in overall size. Subsequently, method 600 continues with step 618. Step 618 involves detecting when the person moves out of the antenna pattern. In response to such a detection, step 620 is performed in which the pedestal's transmit power level is re-set, i.e., returned to its original value. Subsequently, step 622 is performed where method 600 returns to step 604.

If the person is located in the back-field [608:YES], then decision step 612 is performed to determine whether or not distance information associated with a person in the back-field should be used to control transmitter power. If the distance information associated with a person in the back-field should not be used to control transmitter power [612:NO], then step 614 is performed in which method 600 returns to step 604. In contrast, if the distance information associated with a person in the back-field should be used to control transmitter power [612:YES], then the determined distance is used to adaptively control the transmitter field for the transmitter of the pedestal such that the antenna field pattern is decreased in overall size, as shown by step 616. Next step 618 involves detecting when the person moves out of the antenna pattern. In response to such a detection, step 620 is performed in which the pedestal's transmit power level is re-set, i.e., returned to its original value. Subsequently, step 622 is performed where method 600 returns to step 604.

Figure 7:
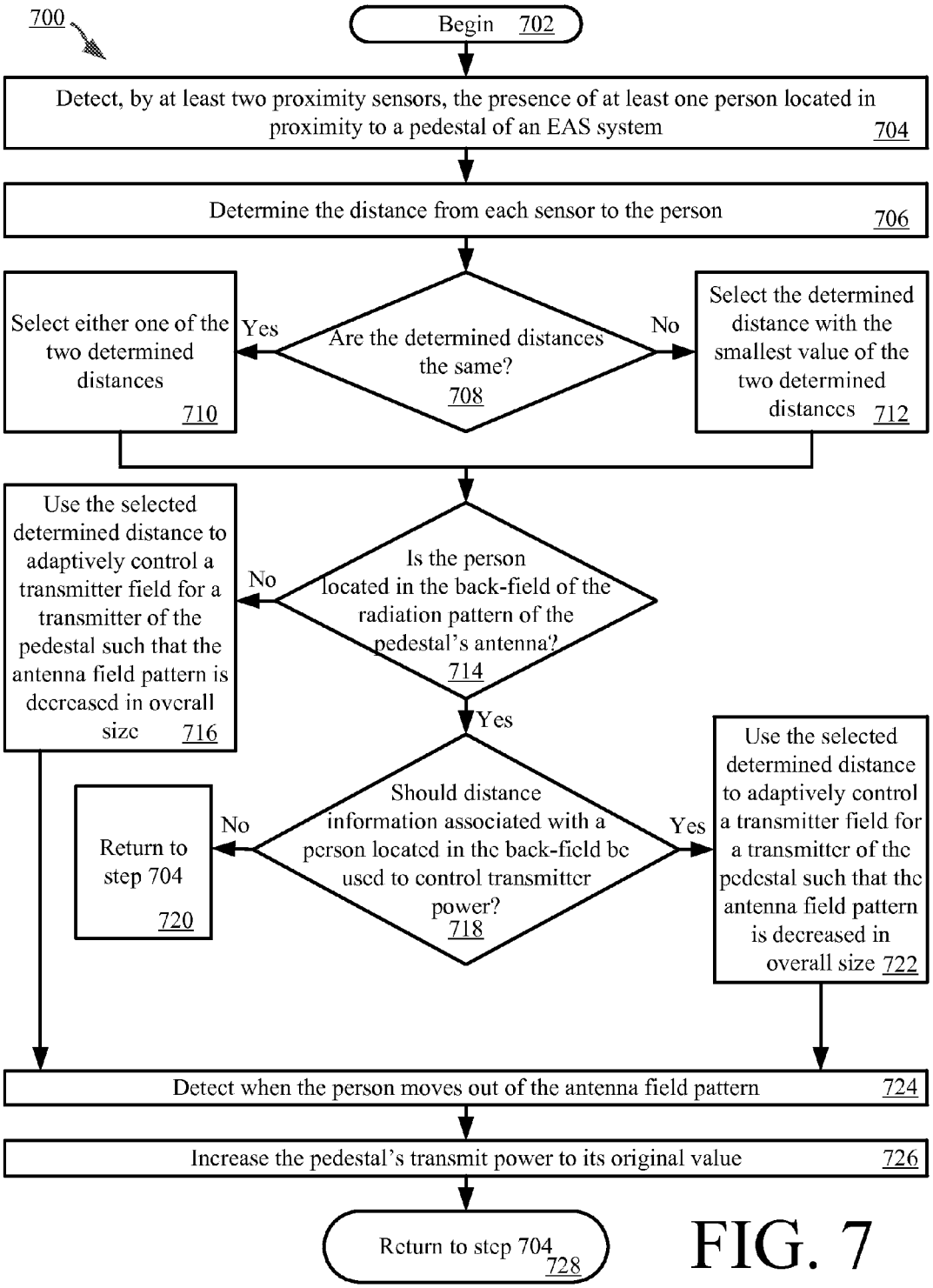

Referring now to FIG. 7, there is provided a flowchart of an exemplary method 700 for adaptively controlling a transmitter field in an EAS detection system. Method 700 illustrates an exemplary process when two proximity sensors provide the same or conflicting distance measurements. For example, in a conflicting distance measurement scenario, a first proximity sensor indicates that a person is two feet from the pedestal. A second proximity sensor indicates that the person is three feet from the pedestal. The following process describes how the conflicting distance information can be handled within system 100.

As shown in FIG. 7, method 700 begins with step 702 and continues with step 704. In step 704, a detection is made by at least two proximity sensors of an EAS detection system. More particularly, each proximity sensor detects the presence of a person located in proximity to a pedestal of the EAS detection system. The distance from each sensor to the detected person is then determined in step 706. Thereafter, a decision step 708 is performed to determine if the two distances are the same.

If the two distances are the same [708:YES], then either one of the two determined distances is selected. In contrast, if the two distances are not the same [708:NO], then the determined distance with the smallest value of the two determined distances is selected, as shown by step 712. Upon completing step 710 or 712, a decision is made as to whether or not the person is located in the back-field of the radiation pattern of the pedestal's antenna.

If the detected person is not located in the back-field [714:NO], then step 716 is performed. Step 716 involves using the selected determined distance to adaptively control a transmitter field for a transmitter of the EAS detection system such that the antenna field pattern is decreased in overall size. Thereafter, in step 724, a detection is made as to when the person moves out of the antenna field pattern. When such a detection is made, the pedestal's transmit power is increased to its original value, as shown by step 726. Subsequently, step 728 is performed where method 700 returns to step 704.

If the detected person is located in the back-field [714:YES], then a decision is made in step 718 as to whether distance information associated with a person located in the back-field should be used to control transmitter power. If such distance information should not be used to control transmitter power [720:NO], then method 700 returns to step 704, as shown by step 720. In contrast, if such distance information should be used to control transmitter power [720:YES], then step 722 is performed where the selected determined distance is used to adaptively control the transmitter field of the pedestal such that the antenna field pattern is decreased in overall size. In a next step 724, a detection is made as to when the person moves out of the antenna field pattern. When such a detection is made, the pedestal's transmit power is increased to its original value, as shown by step 726. Subsequently, step 728 is performed where method 700 returns to step 704.

Figure 8:
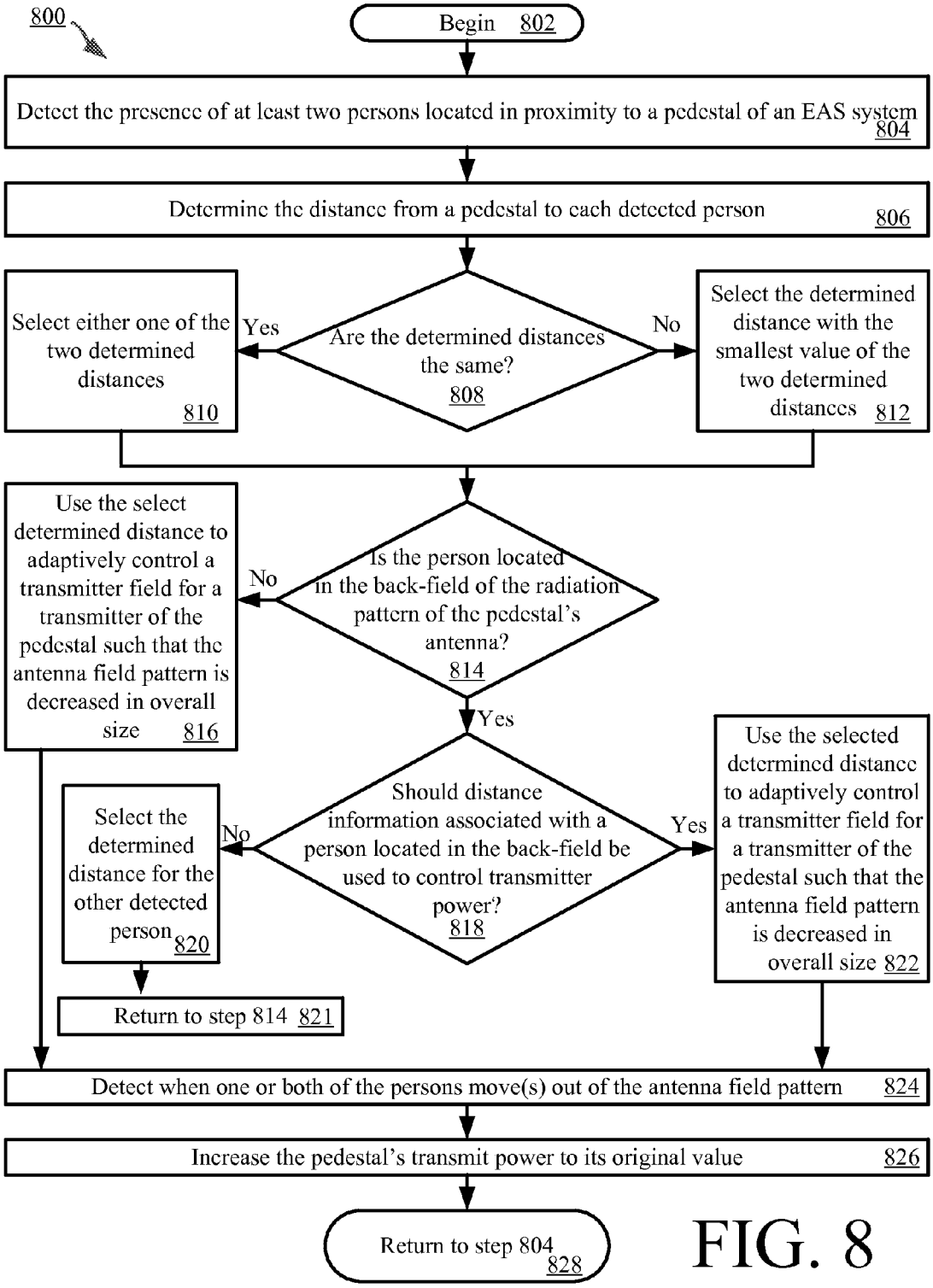

Referring now to FIG. 8, there is provided a flowchart of an exemplary method 800 for adaptively controlling a transmitter field in an EAS detection system. Method 800 illustrates an exemplary process when detections are made indicating that two or more persons are located in proximity to a pedestal. For example, a first proximity sensor detects a first person's presence, while a second proximity sensor detects a second person's presence. The following method 800 describes how system 100 can handle such a situation when the two people reside in the back-field, the two people reside in the front-field, and/or only one person resides in the back-field or front-field.

As shown in FIG. 8, method 800 begins with step 802 and continues with step 804. Step 804 involves detecting the presence of at least two persons located in proximity to a pedestal (e.g., pedestal 102*a* or 102*b* of FIG. 1) of an EAS detection system (e.g., system 100 of FIG. 1). In a next step 806, a distance is determined from the pedestal to each detected person. If the determined distances are the same [808:YES], then either one of the two determined distances is selected in step 810. If the determined distances are not the same [808:NO], then the determined distance with the smallest value of the two determined distances is selected in step 812. Upon completing step 810 or 812, method 800 continues with steps 814-828.

In decision step 814, a determination is made as to whether or not the person, associated with the selected determined distance, is located in the back-field of the radiation pattern of the pedestal's antenna. If the person is not located in the back-field [814:NO], then the selected determined distance is used to adaptively control a transmitter field for a transmitter of the pedestal such that the antenna field pattern is decreased in overall size. Subsequently, step 824 is performed where a detection is made as to when the person moves out of the antenna field pattern. Upon such detection, the pedestal's transmit power is increased to its original value, as shown by step 826. Thereafter, step 828 is performed where method 800 returns to step 804.

If the person is located in the back-field [814:YES], then decision step 818 is performed where a decision is made as to whether or not distance information associated with a person located in the back-field should be used to control transmitter power. If such distance information should not be used in the stated manner [818: NO], then step 820 is performed. In step 820, the other determined distance information is selected (i.e., the determined distance information for the other detected person). Thereafter, method 800 returns to step 814, as shown by step 821.

If such distance information should be used in the stated manner [818:YES], then step 822 is performed in which the selected determined distance information is used to adaptively control a transmitter field for a transmitter of the pedestal such that the antenna field pattern is decreased in overall size. In a next step 824, a detection is made as to when the person moves out of the antenna field pattern. Upon such detection, the pedestal's transmit power is increased to its original value, as shown by step 826. Thereafter, step 828 is performed where method 800 returns to step 804.

Figure 9:
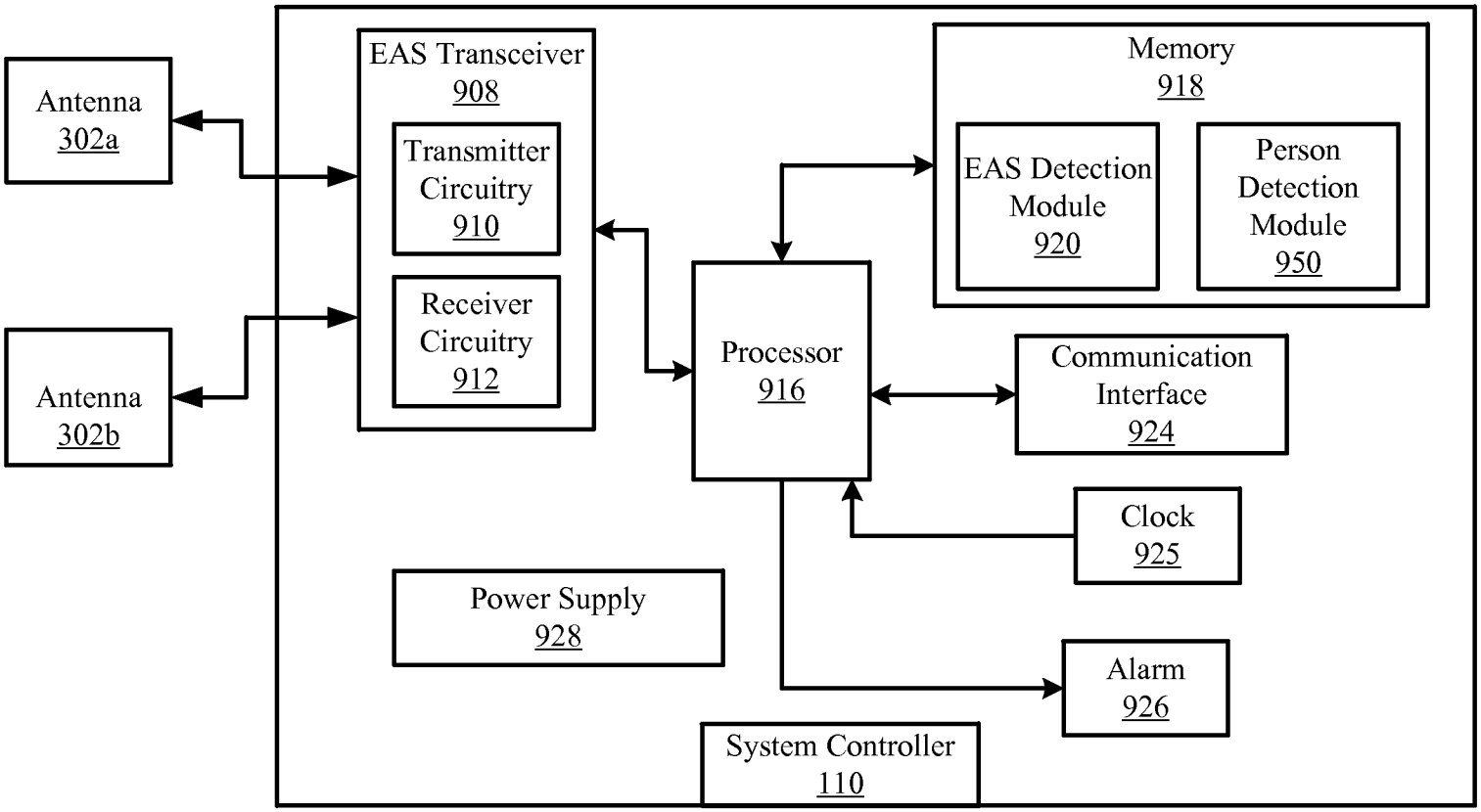
FIG. 9 is a block diagram that is useful for understanding an arrangement of an EAS controller which is used in the EAS detection system of FIG. 1.

Referring now to FIG. 9, there is provided a block diagram that is useful for understanding the arrangement of the system controller 110. The system controller comprises a processor 916 (such as a micro-controller or Central Processing Unit ("CPU")). The system controller also includes a computer readable storage medium, such as memory 918 on which is stored one or more sets of instructions (e.g., software code) configured to implement one or more of the methodologies, procedures or functions described herein. The instructions (i.e., computer software) can include an EAS detection module 920 to facilitate EAS detection and perform methods for selectively issuing an alarm based on a detected location of an EAS security tag, as described herein. The instructions can also include a person detection module 950 to facilitate the detection of persons located in proximity to a pedestal, the determination of the distance from the pedestal to the person, and adaptive control of the transmitter field based on the distance determination. These instructions can also reside, completely or at least partially, within the processor 916 during execution thereof.

The system also includes at least one EAS transceiver 908, including transmitter circuitry 910 and receiver circuitry 912. The transmitter and receiver circuitry are electrically coupled to antenna 302 and the antenna 402. A suitable multiplexing arrangement can be provided to facilitate both receive and transmit operation using a single antenna (e.g. antenna 302 or 402). Transmit operations can occur concurrently at antennas 302, 402 after which receive operations can occur concurrently at each antenna to listen for marker tags which have been excited. Alternatively, transmit operations can be selectively controlled as described herein so that only one antenna is active at a time for transmitting security tag exciter signals for purposes of executing the various algorithms described herein. The antennas 302, 402 can include an upper and lower antenna similar to those shown and described with respect to FIG. 1. Input exciter signals applied to the upper and lower antennas can be controlled by transmitter circuitry 910 or processor 916 so that the upper and lower antennas operate in a phase aiding or a phase opposed configuration as required.

Additional components of the system controller 110 can include a communication interface 924 configured to facilitate wired and/or wireless communications from the system controller 110 to a remotely located EAS system server. The system controller can also include a real-time clock, which is used for timing purposes, an alarm 926 (e.g. an audible alarm, a visual alarm, or both) which can be activated when an active EAS security tag is detected within the EAS detection zone 108. A power supply 928 provides necessary electrical power to the various components of the system controller 110. The electrical connections from the power supply to the various system components are omitted in FIG. 9 so as to avoid obscuring the invention.

Those skilled in the art will appreciate that the system controller architecture illustrated in FIG. 9 represents one possible example of a system architecture that can be used with the present invention. However, the invention is not limited in this regard and any other suitable architecture can be used in each case without limitation. Dedicated hardware implementations including, but not limited to, application-specific integrated circuits, programmable logic arrays, and other hardware devices can likewise be constructed to implement the methods described herein. It will be appreciated that the apparatus and systems of various inventive embodiments broadly include a variety of electronic and computer systems. Some embodiments may implement functions in two or more specific interconnected hardware modules or devices with related control and data signals communicated between and through the modules, or as portions of an application-specific integrated circuit. Thus, the exemplary system is applicable to software, firmware, and hardware implementations.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application. Thus, the breadth and scope of the present invention should not be limited by any of the above described embodiments. Rather, the scope of the invention should be defined in accordance with the following claims and their equivalents.

What is claimed is:

1. A method for adaptively controlling a transmitter field in an Electronic Article Surveillance ("EAS") detection system, comprising:

detecting, by at least one first proximity sensor, a presence of a first person located in proximity to a pedestal of the EAS detection system;

determining a first distance from the first proximity sensor to the first person;

determining a second distance from a second proximity sensor to the first person or a second person;

comparing the first distance to the second distance; and using the results of the comparing to adaptively control the transmitter field of the EAS detection system.

2. The method according to claim 1, further comprising determining if the first person is located in a back-field of a radiation pattern of an antenna of the first pedestal.

3. The method according to claim 2, further comprising performing the using step only if it is determined that the first person is not located in the back-field of the radiation pattern of the antenna of the first pedestal.

4. The method according to claim 1, further comprising returning a transmit power of the first pedestal to a previous level when the first person moves out of an antenna field pattern.

5. A method for adaptively controlling a transmitter field in an Electronic Article Surveillance ("EAS") detection system, comprising:

detecting, by at least one first proximity sensor, a presence of a first person located in proximity to a pedestal of the EAS detection system;

determining a first distance from the first proximity sensor to the first person; and using the first distance to adaptively control the transmitter field of the EAS detection system;

determining if the first person is located in a back-field of a radiation pattern of an antenna of the first pedestal; and performing the using step if it is determined that the first person is located in the back-field of the radiation pattern of the antenna of the first pedestal and if distance information associated with a person located in the back-field should be used to control transmit power of a pedestal.

6. A method for adaptively controlling a transmitter field in an Electronic Article Surveillance ("EAS") detection system, comprising:

detecting, by at least one first proximity sensor, a presence of a first person located in proximity to a pedestal of the EAS detection system;

determining a first distance from the first proximity sensor to the first person; and using the first distance to adaptively control the transmitter field of the EAS detection system;

determining a second distance from a second proximity sensor to the first person; and determining if the first and second distances are the same.

7. The method according to claim 6, further comprising:

selecting either of the first and second distances for use in controlling transmit power if a determination is made that the first and second distances are the same, or selecting a smallest distance from the first and second distances if a determination is made that the first and second distance are not the same; and using the first, second or smallest distance which was previously selected to control transmit power.

8. A method for adaptively controlling a transmitter field in an Electronic Article Surveillance ("EAS") detection system, comprising:

detecting, by at least one first proximity sensor, a presence of a first person located in proximity to a pedestal of the EAS detection system;

determining a first distance from the first proximity sensor to the first person; and using the first distance to adaptively control the transmitter field of the EAS detection system;

detecting a presence of a second person located in proximity to a pedestal of the EAS detection system while the first person is located in proximity to the pedestal;

determining a second distance from the pedestal to the second person; and determining if the first and second distances are the same.

9. The method according to claim 8, further comprising selecting either of the first and second distances for use in controlling transmit power if a determination is made that the first and second distances are the same.

10. The method according to claim 8, further comprising:

selecting a smallest distance from the first and second distances if a determination is made that the first and second distance are not the same; and using the smallest distance to control transmit power (A) if it is determined that the person associated with the smallest distance is not located in the back-field of the radiation pattern of the antenna of the first pedestal, or (B) if it is determined that the person associated with the smallest distance is located in the back-field of the radiation pattern of the antenna of the first pedestal and if distance information associated with a person located in the back-field should be used to control transmit power of a pedestal.

11. An Electronic Article Surveillance ("EAS") detection system, comprising:

at least one proximity sensor detecting a presence of a first person located in proximity to a pedestal of the EAS detection system; and a system controller determining a first distance from a first proximity sensor to the first person, determining a second distance from a second proximity sensor to a second person, comparing the first distance to the second distance, and using the results of the comparing to adaptively control a transmitter field of the EAS detection system.

12. The EAS detection system according to claim 11, wherein the system controller further determines if the first person is located in a back-field of a radiation pattern of an antenna of the first pedestal.

13. The EAS detection system according to claim 12, wherein the system controller uses the first distance to adaptively control the transmitter field only if it is determined that the first person is not located in the back-field of the radiation pattern of the antenna of the first pedestal.

14. The EAS detection system according to claim 11, wherein the system controller further returns a transmit power of the first pedestal to a previous level when the first person moves out of an antenna field pattern.

15. An Electronic Article Surveillance ("EAS") detection system, comprising:

at least one proximity sensor detecting a presence of a first person located in proximity to a pedestal of the EAS detection system; and a system controller determining a first distance from a first proximity sensor to the first person, and using the first distance to adaptively control a transmitter field of the EAS detection system;

wherein the system controller further determines if the first person is located in a back-field of a radiation pattern of an antenna of the first pedestal; and wherein the system controller uses the first distance to adaptively control the transmitter field if it is determined that the first person is located in the back-field of the radiation pattern of the antenna of the first pedestal and if distance information associated with a person located in the back-field should be used to control transmit power of a pedestal.

16. An Electronic Article Surveillance ("EAS") detection system, comprising:

at least one proximity sensor detecting a presence of a first person located in proximity to a pedestal of the EAS detection system; and a system controller determining a first distance from a first proximity sensor to the first person, using the first distance to adaptively control a transmitter field of the EAS detection system;

determining a second distance from a second proximity sensor to the first person; and determining if the first and second distances are the same.

17. The EAS detection system according to claim 16, wherein the system controller further:

selects either the first distance or the second distance for use in controlling transmit power if a determination is made that the first and second distances are the same, or selects a smallest distance from the first and second distances if a determination is made that the first and second distance are not the same; and uses the first, second or smallest distance which was previously selected to control transmit power.

18. An Electronic Article Surveillance ("EAS") detection system, comprising:

at least one proximity sensor detecting a presence of a first person located in proximity to a pedestal of the EAS detection system; and a system controller determining a first distance from a first proximity sensor to the first person, using the first distance to adaptively control a transmitter field of the EAS detection system;

detecting a presence of a second person located in proximity to a pedestal of the EAS detection system while the first person is located in proximity to the pedestal;

determining a second distance from the pedestal to the second person; and determining if the first and second distances are the same.

19. The EAS detection system according to claim 18, wherein either the first distance or the second distance is selected for use in controlling transmit power if a determination is made that the first and second distances are the same.

20. The EAS detection system according to claim 19, wherein a smallest distance is selected from the first and second distances if a determination is made that the first and second distance are not the same, and the smallest distance is used to control transmit power (A) if it is determined that the person associated with the smallest distance is not located in the back-field of the radiation pattern of the antenna of the first pedestal, or (B) if it is determined that the person associated with the smallest distance is located in the back-field of the radiation pattern of the antenna of the first pedestal and if distance information associated with a person located in the back-field should be used to control transmit power of a pedestal.

* * * * *